US005472390A

United States Patent [19]

Faye

[11] Patent Number: 5,472,390

[45] Date of Patent: Dec. 5, 1995

[54] STEP EXERCISER HAVING REBOUNDING TREAD

[76] Inventor: Karen A. Faye, 454 Dunstable Rd., Tyngsboro, Mass. 01879

[21] Appl. No.: 266,148

[22] Filed: Jun. 27, 1994

[51] Int. Cl.[6] ..... A63B 23/04

[52] U.S. Cl. ..... 482/52; 482/27; 482/51

[58] Field of Search ..... 482/51, 27, 147, 482/52, 146

[56] References Cited

U.S. PATENT DOCUMENTS

| | | | |
|---|---|---|---|
| 2,837,837 | 6/1958 | Castle | 434/250 |
| 3,767,009 | 10/1973 | Sidlinger . | |
| 3,767,192 | 10/1973 | Eriksson . | |
| 3,831,936 | 8/1974 | Watson et al. . | |
| 3,892,403 | 7/1975 | Greer | 482/52 |
| 4,037,834 | 7/1977 | Oaks | 482/51 |
| 4,119,311 | 10/1978 | Jenkins et al. . | |
| 4,381,861 | 5/1983 | Howell, Jr. et al. . | |
| 4,386,772 | 1/1983 | Wu . | |
| 4,598,905 | 7/1986 | Vrana . | |
| 4,630,816 | 12/1986 | Hill | 482/51 |
| 4,836,530 | 6/1989 | Stanley, Jr. . | |
| 4,900,011 | 2/1990 | Nolet . | |
| 5,050,861 | 9/1991 | Thomas et al. | 482/51 |

*Primary Examiner*—Stephen R. Crow
*Assistant Examiner*—Jerome Donnolly
*Attorney, Agent, or Firm*—Cesari and McKenna

[57] ABSTRACT

An in-place exerciser for step aerobic exercise and the like has a base with a cavity defining a receptacle and having a floor. The exerciser also includes a rebound structure with a rigid frame defining a closed loop that corresponds substantially to the size and shape of the receptacle and a sheet of flexible, resilient trampoline material whose edge margin is secured directly to the frame so that the sheet is stretched tightly on the frame. The rebound structure is seated in the receptacle so that said sheet is substantially flush with the top of the base and spaced above said floor of the receptacle.

3 Claims, 1 Drawing Sheet

STEP EXERCISER HAVING REBOUNDING TREAD

FIELD OF THE INVENTION

This invention relates to in-place exercise equipment. It relates more particularly to a step-type aerobic exerciser having a rebounding tread in the form of a trampoline.

BACKGROUND OF THE INVENTION

In-place aerobic exercising has become the exercise of choice for many in recent years. Step aerobics, which involves the use of a raised step or small platform, has enjoyed wide popularity in particular. In a step aerobic routine, one repeatedly steps up and down between the floor and the raised platform and/or performs a series of maneuvers on the platform designed to fully exert the cardiovascular system.

The raised platform most often used in step aerobics is typically supported by a sturdy, low-profile base unit formed of high impact plastic or other strong, lightweight material with rounded edges. The platform is typically integrally formed with the base and thus is made of the same high impact material. The entire unit is thus safe, durable, inexpensive, compact, and easy to carry or stow away, which may be at least part of the reason for the popularity of step aerobics.

Risers of one kind or another can typically be removably attached to the bottom of the base unit. When so attached, the risers raise the level of the platform above the floor, thus requiring the user to exert more aerobic effort. As a user becomes more proficient at a given exercise routine, risers of increasingly larger size may be used with the same basic step unit, to permit the user to select the level of effort appropriate for him or her.

One drawback of step aerobics is that repeated stepping up and down on the platform results in repeated impacts upon the ankles, feet, knees, hips, and leg and foot muscles. These repetitious impacts can eventually produce undesirable excessive stress on the muscles and even bone structure, as well as irritation to nerves.

It is known to provide trampoline devices for jump exercising, which are attractive because of their highly resilient surfaces which provide rebound force while reducing abnormal stresses to the body. Examples of such trampolines are found in U.S. Pat. Nos. 3,767,009, 3,767,192, 4,119,311 and 4,381,861. Trampolines usually comprise a perimeter frame which is supported above the floor by legs. Positioned within the frame is a mat which is connected around its perimeter to the frame by springs so that the mat is resiliently supported by the flames.

At first glance, one might think it would be easy to combine the qualities of a step exerciser with those of a trampoline. In actuality, however, that has not proven to be the case. Although there are scaled-down versions of trampolines that may be used in the home and in other places where ceiling heights are limited, none of these scaled down trampolines has to date been successfully adapted to step aerobics.

One reason is that such trampoline devices utilize springs to support the jumping surface. Such springs typically provide too much resilience, that is, their rebounding action is typically much greater than that which is normally considered suitable for step aerobics.

Another reason is that trampolines, in order to remain stabile, must have a relatively high profile above the floor. This requires the user to jump much higher than is normally considered appropriate for step aerobics.

The presence of springs, typically disposed around the perimeter of the mat, also represent a hazard of sorts for stepping. The springs themselves are not particularly resilient, and when one attempts to perform the repeated stepping on and off of the platform required in normal step aerobic routines, invariably the springs end up being stepped upon rather than the mat. This not only upsets the exercise pattern, but may also lead to injury.

Conventional trampolines, even the scaled down ones, also tend to be relatively complicated and expensive devices, and require many heavy metal parts as well as the multitude of springs to reliably support the trampoline mat. Because of the weight of these springs metal pans and the aforementioned high profile and large foot print, trampolines are more difficult to transport and stow away than standard step aerobic devices.

SUMMARY OF THE INVENTION

Accordingly, the present invention aims to provide an improved in-place exerciser for performing step aerobics.

Another object of the invention is to provide such an exerciser which increases the level of cardiovascular activity when following a given step aerobic routine.

A further object of the invention is to provide such an exerciser which conforms as much as possible to the shape, size, and light weight of a conventional step exerciser, so that it can be used, carried, and stored in much the same way.

A still further object of the invention is to provide an exerciser which can be used with existing step accessories, such as risers that can be adapted to control the height of the platform.

Still another object is to provide a step exerciser which provides a new type of stepping surface which can be interchanged with an existing step exercise device during an aerobic workout to add a more difficult degree of intensity to the workout without increasing the risk of causing injury.

Yet another object is to provide a step exerciser with new type of stepping surface that may be used together with an existing step aerobic device having a conventional stepping surface so that the exerciser may achieve the most comprehensive and effective aerobic conditioning possible.

Yet another object of the invention is to provide a step exerciser which minimizes the impact on the muscles, nerves, and bone structure. Another object of the invention is to provide an exerciser of this type which is relatively lightweight and inexpensive to manufacture.

A further object of the invention is to provide a step exerciser which is stabile and safe to use.

Still another object is to provide a step aerobic exerciser which provides improved cueing to provide more effective instruction in the proper use of the device to obtain maximum benefit, even to large groups of people at once or through the use of videotapes.

One other object of the invention is to provide a step aerobic exerciser which is easier and more fun to use than existing exercisers, by affording an additional way to specify how a step aerobic routine is to be followed.

Other objects will, in part, be obvious and will, in part, appear hereinafter. The invention accordingly comprises the features of construction, combination of elements and arrangement of parts which will be exemplified in the following detailed description. The scope of the invention will be indicated in the following claims.

The above objects of the invention are achieved by providing a step exerciser having a generally rectangular shaped base unit adapted to rest on the floor or other such horizontal surface. Seated on the base is a rebound structure consisting of a generally rectangular frame which holds a flexible, resilient mat formed of trampoline-type material whose entire edge margin is connected directly to that frame so that the mat is held taut and in place on the base.

Preferably, the mat is divided along its length into a plurality of different color blocks so that the individual using the exerciser can follow a precise exercise routine involving stepping on the different-color mat blocks in a precise order.

Except for the mat per se, the exerciser can be made substantially entirely of molded plastic parts which are easy to make. Therefore, the overall cost of the device is less than the cost of conventional scaled-down trampolines. Furthermore, as we shall see, the exerciser has a very low profile and a small footprint. Therefore, it can be easily transported, moved, stacked, and/or stowed out of the way such as trader a bed or in a closet when not in use. In addition, its form factor can be the same as other step aerobic base units, which permits one to use standard accessories, such as risers that control the height of the unit above the floor.

BRIEF DESCRIPTION OF THE DRAWINGS

For a fuller understanding of the nature and objects of the invention, reference should be had to the following detailed description, taken in connection with the accompanying drawing, in which.

DETAILED DESCRIPTION OF AN ILLUSTRATIVE EMBODIMENT

Figure 1:
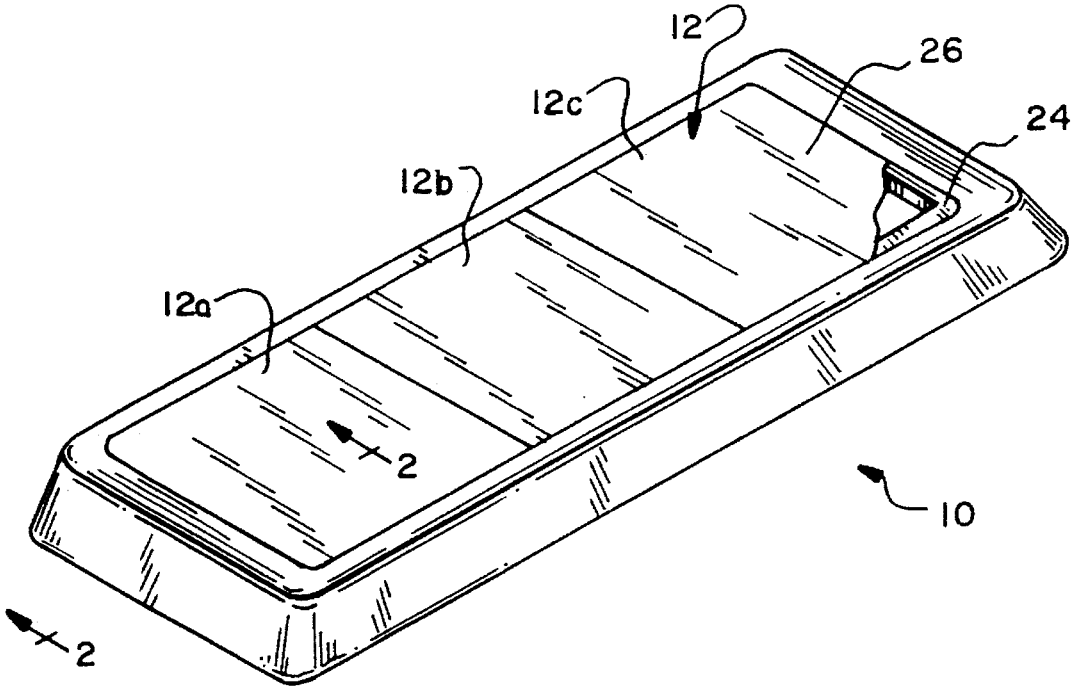
FIG. 1 is an isometric view with parts broken away of an in-place exerciser incorporating my invention.

Referring to FIG. 1 of the drawing, a step exerciser according to the invention comprises a generally rectangular base unit 10 which supports a generally rectangular, resilient, rebounding structure shown generally at 12 which is flush with the top of the base 10. Preferably, the exposed upper surface of the rebound structure 12 is divided lengthwise into a plurality of different color blocks or segments. The illustrated exerciser has three such segments 12*a*, 12*b* and 12*c*, with a first block 12*a* being blue, a second block 12*b* being purple and a third block 12*c* being green, for example.

One may use the exerciser by stepping, jumping, or hopping up onto and then down off of the resilient rebound structure 12, or by using plyometric or propulsion movements in much the same manner as one uses the tread of a conventional step exerciser. When the invention is used in this way, however, the rebound structure 12 allows the user to achieve a greater level of cardiovascular output with minimal, non-impacting effort.

One may make use of the different color blocks 12*a* to 12*c* of the rebound structure 12, to more easily follow a prescribed aerobic routine. The color blocks permit an instructor, for example, to identify different areas of the exerciser to be stepped upon by calling out the color of the blocks in the desired order. The user can then rely solely on the verbal cues and not take his or her eyes off the step exerciser, thereby reducing the possibility of injury through a missed footing.

The base 10 is formed of a lightweight, impact-resistant material such as high density polyethylene, so that when the exerciser is not in use, it may be easily picked up, moved, stacked upon one another, or stowed out of the way in the much same manner as a conventional step exerciser.

Figure 2:
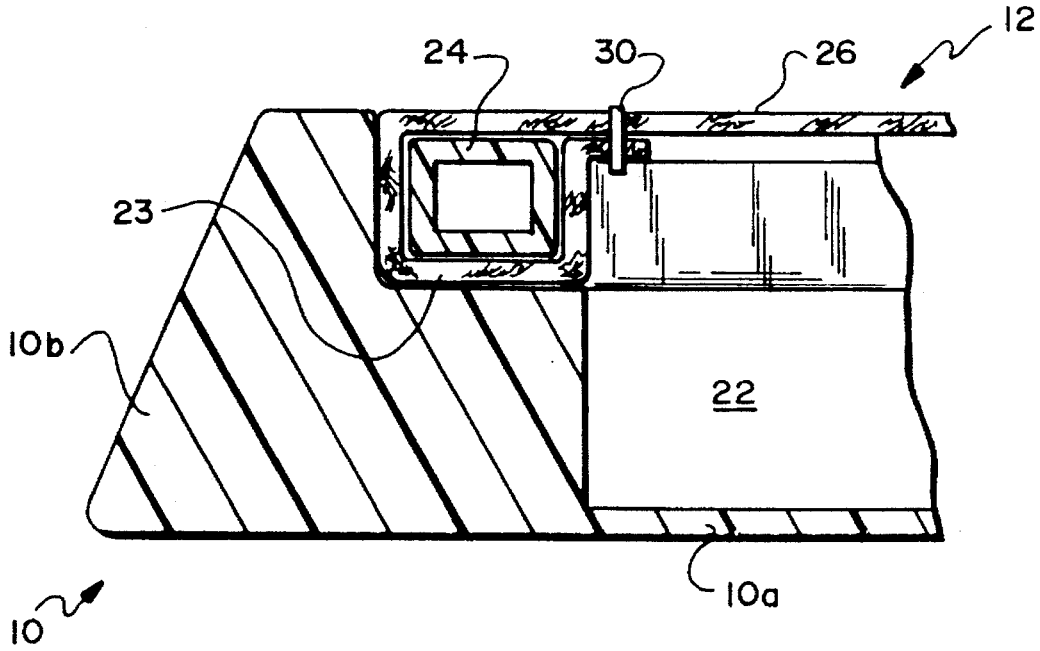
FIG. 2 is a sectional view on a larger scale taken along line 2—2 of FIG. 1.

Referring now more particularly to both FIGS. 1 and 2, the base 10 is a low profile, preferably rectangular structure comprising a bottom wall 10*a*, a pair of inclined side walls 10*b*, and a pair of similar inclined end walls 10*c* which together define an interior generally rectangular receptacle or cavity 22. Preferably, the cavity 22 has an enlarged mouth or entrance thereby forming a shelf 23 which extends around the upper periphery of the cavity 22. Typically, the base 10 has a length of about twenty four to thirty six inches, a width of about twelve to eighteen inches and a height of about six inches. The base 10 is molded of a strong, impact resistant plastic material such as high density polyethylene. For example, the base 10 may generally conform to the size, shape, and weight of the step aerobic devices sold under the trademark "Step Reebok®" by Reebok International Ltd. of Canton, Mass.

The rebound structure 12 comprises a frame 24 having substantially the same size and shape as the mouth of cavity 22 and a sheet 26 of very strong, flexible, resilient material of the type commonly used in trampolines. The sheet of material is stretched to fit tightly across the frame 24.

The rebound structure 12 is also shaped and adapted to be press-fit tightly into the mouth of receptacle 22 in the base 10, or otherwise securely seated on the shelf 23, so that the top of the rebound structure 12 remains flush with the top of the base 10 during repeated stepping.

The frame 24 of the rebound structure 12 is preferably formed as a tubular ring with a square cross-section made of a strong, rigid plastic material such as polycarbonate, so the frame 24 itself is quite rigid. The edge margin of the material sheet 26 is wrapped directly around the frame 24 and secured to the underside of the sheet 26 inboard of the frame 24 by a fastening means 30 such as heavy stitching, rivets or the like so that the sheet 26 is stretched and held tightly across the frame 24.

The rebound structure 12 thus presents a safe rebounding surface for the rapid stepping movements required in step aerobic routines.

The level of effort required to step on and off the surface of the rebounding structure 12 is greater than the level of effort required to step on and off a non-resilient tread in a standard step aerobic device. An increased level of cardiovascular activity thus results for a given step aerobic routine with the invention.

At the same time, since the rebound structure 12 is resilient, far less stress is placed on the muscles and bones in repeated use.

Because the upper surface of the rebound structure 12 is flush with the top of the base 10, the unit is safe to use, with no chance for the user to jam his or her foot between the base and the rebound structure 12 or other supporting surfaces, as would be the case with a standard trampoline device.

Since the rebound structure 12 does not use springs or other support structure in the manner of a trampoline, the amount of rebounding force provided is appropriate for step exercises. Furthermore, the entire device retains a low profile and light weight.

The illustrated exerciser may be used by itself in the same manner as a conventional step exerciser. For example, because the base 10 conforms generally to the size, shape, and weight of such standard step exercise devices, the base 10 may also be used standard accessories for step aerobics such as risers that raise or lower the height of the rebound surface 12 with respect to the floor.

The material 26 forming the rebound surface 12 can be provided with multiple sections each having a different color. For example, three blocked areas 12*a*, 12*b*, and 12*c* may be rendered in fabric colors such as blue, purple, and green, respectively, defining a left, center, and right side of the exerciser. An aerobic routine that requires one to step to one section of the rebounding surface 12 or another can then be specified by calling out a series of colors.

For example, to identify a step aerobic routine in which the user should step to the left, next to the right, and then to the center:

"step to the blue, . . . ,the green, . . . , and now to the purple."

The color blocked sections thus provide an added advantage to aerobic instructors and others who devise step aerobic routines, while making it easier for beginners to recognize which areas of the exercise device on which they should be stepping and in which order. This can be done by listening to the verbal cues, and focusing on watching one's step, without watching the instructor, thereby reducing the possibility of losing one's footing or falling off the step.

The cueing afforded by the color blocking also affords a more effective an efficient way to instruct novices in the proper use of the device. For example, even large groups of people or a videotaped instruction can be told to "step to the green", and the correct area of the tread will be immediately evident to all.

It will thus be seen that the objects set forth above, among those made apparent from the preceding description, are efficiently attained. Also, since certain changes may be made in the above construction without departing from the scope of the invention, it is intended that all matter contained in the above description or shown in the accompanying drawing shall be interpreted as illustrative and not in a limiting sense.

It also to be understood that the following claims are intended to cover all of the generic and specific features of the invention described herein.

I claim:

1. An in-place exerciser comprising:

a base having an open top, a bottom and incline side walls and defining a generally rectangular receptacle;

an inside shelf formed in the base, said shelf extending all around the receptacle between said top and bottom of the base, and a rebound structure, said rebound structure including a rigid, generally rectangular, tubular frame defining a closed loop that corresponds substantially to the size and shape of the receptacle, a sheet of flexible resilient trampoline material, said material having edges all of which are wrapped around said frame all around the sheet, and securing means for securing the edge margin of said sheet to portions of the sheet inboard said frame so that the sheet is stretched tight on the frame, the thickness of said rebound structure being substantially the same as the distance between said shelf and the top of the base so that when the rebound structure is seated on the shelf, said sheet is supported all around and is substantially flush with the top of the base and spaced above the bottom of the base.

2. The exerciser defined in claim 1 wherein said sheet is divided lengthwise into a plurality of different color blocks.

3. The exerciser defined in claim 1 wherein said base and said frame are of a rigid plastic material.

* * * * *